US011273090B2

(12) United States Patent
Kohler et al.

(10) Patent No.: US 11,273,090 B2
(45) Date of Patent: Mar. 15, 2022

(54) OPERATING TABLE AND METHOD FOR OPERATING THE OPERATING TABLE

(71) Applicant: TRUMPF MEDIZIN SYSTEME GMBH + CO. KG, Saalfeld (DE)

(72) Inventors: Matthias Kohler, Saalfeld (DE); Matthias Jager, Rudolstadt (DE)

(73) Assignee: TRUMPF MEDIZIN SYSTEME GMBH + CO. KG, Saalfeld (DE)

( * ) Notice: Subject to any disclaimer, the term of this patent is extended or adjusted under 35 U.S.C. 154(b) by 197 days.

(21) Appl. No.: 16/695,297

(22) Filed: Nov. 26, 2019

(65) Prior Publication Data

US 2020/0170869 A1 Jun. 4, 2020

(30) Foreign Application Priority Data

Nov. 29, 2018 (EP) ..... 18209194

(51) Int. Cl.
*A61G 13/06* (2006.01)
*A61G 13/04* (2006.01)
*A61G 13/02* (2006.01)

(52) U.S. Cl.
CPC ..... *A61G 13/06* (2013.01); *A61G 13/04* (2013.01); *A61G 13/02* (2013.01); *A61G 2203/36* (2013.01); *A61G 2203/42* (2013.01)

(58) Field of Classification Search
CPC ..... A61G 13/06; A61G 13/02; A61G 13/04; A61G 2203/36; A61G 2203/42
USPC ..... 5/608, 607, 609–611
See application file for complete search history.

(56) References Cited

U.S. PATENT DOCUMENTS 4,195,829 A * 4/1980 Reser ..... A61G 13/02 5/607
4,572,493 A * 2/1986 Hubert ..... A61G 13/04 5/608
5,398,356 A * 3/1995 Pfleger ..... A61B 6/04 5/601
5,528,782 A * 6/1996 Pfeuffer ..... A61G 13/02 108/147
5,621,933 A * 4/1997 Knapp ..... A61G 7/018 5/607
6,470,519 B1 * 10/2002 Pattee ..... A61B 6/105 5/600
6,640,363 B1 * 11/2003 Pattee ..... A61G 13/04 5/601
7,784,126 B2 * 8/2010 Meissner ..... A61G 13/08 5/600
8,677,536 B2 * 3/2014 Douglas ..... A61G 7/05769 5/713
9,038,218 B1 * 5/2015 Heil ..... A61G 5/006 5/618

(Continued)

FOREIGN PATENT DOCUMENTS

CN 101357096 A 2/2009
CN 103860275 A 6/2014

(Continued)

*Primary Examiner* — Robert G Santos
(74) *Attorney, Agent, or Firm* — Barnes & Thornburg LLP

(57) ABSTRACT

An operating table is provided. The operating table comprises a base including a column, a tabletop supported by the column, at least one sensor configured to directly detect a change of position of the tabletop, and a controller configured to process signals of the at least one sensor in order to determine a position of the tabletop.

20 Claims, 4 Drawing Sheets

(56) References Cited

U.S. PATENT DOCUMENTS

| | | | | |
|---|---|---|---|---|
| 10,149,794 | B2 * | 12/2018 | Clayton | A61G 13/02 |
| 10,206,841 | B2 * | 2/2019 | Soltermann | A61G 13/04 |
| 10,357,413 | B2 * | 7/2019 | Buerstner | A61G 13/08 |
| 10,646,389 | B2 * | 5/2020 | Heil | A61G 7/015 |
| 2004/0148703 | A1 | 8/2004 | Doering et al. | |
| 2009/0031497 | A1 * | 2/2009 | Meissner | A61G 13/10 5/607 |
| 2011/0113561 | A1 * | 5/2011 | Douglas | A61G 7/05769 5/713 |
| 2015/0216749 | A1 * | 8/2015 | Heil | A61G 7/0506 5/617 |
| 2016/0089287 | A1 * | 3/2016 | Buerstner | A61G 13/105 5/616 |
| 2016/0095773 | A1 | 4/2016 | Ruch et al. | |
| 2016/0106611 | A1 * | 4/2016 | Clayton | A61G 13/02 5/616 |
| 2017/0196748 | A1 | 7/2017 | Gaiser | |
| 2018/0133083 | A1 * | 5/2018 | Clayton | A61G 13/06 |
| 2018/0193216 | A1 * | 7/2018 | Soltermann | A61G 13/04 |
| 2019/0175431 | A1 * | 6/2019 | Clayton | A61G 13/08 |
| 2020/0069499 | A1 * | 3/2020 | Gonser | A61G 13/08 |
| 2020/0170869 | A1 * | 6/2020 | Kohler | A61G 13/04 |
| 2020/0230001 | A1 * | 7/2020 | Heil | A61G 7/16 |
| 2021/0137460 | A1 * | 5/2021 | Kohler | A61G 13/04 |

FOREIGN PATENT DOCUMENTS

| | | | | |
|---|---|---|---|---|
| CN | 203749767 | U | 8/2014 | |
| CN | 105377210 | A | 3/2016 | |
| CN | 106137655 | A | 11/2016 | |
| CN | 106137655 | A | 11/2016 | |
| CN | 107072629 | A | 8/2017 | |
| CN | 107582305 | A | 1/2018 | |
| DE | 19929907 | | 12/2000 | |
| EP | 1419756 | | 5/2004 | |
| EP | 3659569 | A1 * | 6/2020 | A61G 13/04 |
| GB | 2305419 | | 4/1997 | |
| WO | WO2001/08621 | | 2/2001 | |

* cited by examiner

OPERATING TABLE AND METHOD FOR OPERATING THE OPERATING TABLE

CROSS-REFERENCE TO RELATED APPLICATIONS

This application claims the benefit of European Patent Application Serial No. 18209194.2, filed on Nov. 29, 2018, the entire disclosure of which is incorporated herein by reference in its entirety.

TECHNICAL FIELD

The present disclosure relates to an operating table and a method for operating the operating table, in particular to an operating table provided with adjustable components.

BACKGROUND

Hitherto, operating tables provided with adjustable components have been known. Recently, these operating tables are provided with motor-driven components which enable a smooth and comfortable adjustment of positions of the motor-driven components even though patients are lying on a tabletop of the operating table.

Nowadays, due to requirements to an accuracy of tabletop positions, in particular in case of robot assisted surgery or tracked motions in a control system of an operating theater, an exact position of a tabletop is necessary. However, a position of the tabletop can vary due to a shift of the weight force at the center of gravity of the patient lying on the tabletop with respect to a support structure of the tabletop because of an elasticity of a structure of the operating table whereby the structure of the operating table bends. Furthermore, in extreme positions of the tabletop, the structure of the operating table can be damaged or the operating table can tip due to the eccentric weight force so that there is a risk that patients lying on the operating table or persons in the vicinity of the operating table are injured.

Moreover, due to design requirements, a location of a force application of a Trendelenburg drive and a location of a force application of a tilting drive are such that, during a motion by the Trendelenburg drive, an angle of the tabletop around a longitudinal direction of the tabletop varies. A similar effect emerges if the tabletop in a Trendelenburg position tilts around its longitudinal axis so that the tabletop tilts around a transverse axis of the operating table.

Therefore, the object underlying the present disclosure is to provide an operating table and a method for operating an operating table providing an improved determination of a position of the tabletop and an improved accuracy in the motions of the operating table without providing a cost-intensive equipment.

SUMMARY

The present disclosure includes one or more of the features recited in the appended claims and/or the following features which, alone or in any combination, may comprise patentable subject matter.

According to an aspect of the present disclosure, an operating table comprises a base including a column, a tabletop supported by the column, at least one sensor configured to directly detect a change of position of the tabletop, and a controller configured to process signals of the at least one sensor in order to determine a position of the tabletop.

By this configuration, due to the sensor directly detecting the change of position of the tabletop, a cost-effective construction of the operating table is achievable while exactly determining the position of the tabletop. In this context, "directly" means that the sensor or a part of the sensor transmitting a motion of the tabletop to the sensor is directly attached to the tabletop and configured to directly detect a change of position of the tabletop. Sensors indirectly detecting a position of the tabletop, e.g. an angular encoder included in a driving mechanisms, do not determine the actual position of the tabletop or other components of the table or tabletop.

In an embodiment of the operating table, the operating table comprises, as being one of the at least one sensor, a string potentiometer configured to detect a change of position of the tabletop with respect to the base in a vertical direction.

When using the string potentiometer as a measuring device which is directly detecting the position of the tabletop, i.e., independent from a support structure of the tabletop, an exact determination of a height of the tabletop independent from a resilience of the support structure is possible.

In a further embodiment of the operating table, the base comprises a first driving mechanism, the driving mechanism being configured to perform a height adjustment of the tabletop by changing a position of the tabletop in the vertical direction, and the controller is configured to process the signals of the at least one sensor to determine the position of the tabletop in the vertical direction, i.e., an actual height of the tabletop.

Due to this configuration, a height adjustment of the tabletop and an exact determination of the height of the tabletop independently from the driving mechanism is possible so that a resilience or tolerances of the driving mechanism does not influence the determination result.

In a further embodiment of the operating table, it comprises at least one of a first inclinometer and a first acceleration sensor attached to the base, wherein the controller processes signals of the at least one of the first inclinometer and the first acceleration sensor for determining a base angle of the operating table.

When additionally providing at least one of the first inclinometer and the first acceleration sensor at the base, plausibility of the sensor directly detecting the change of position of the tabletop and further characteristics of the operating table, as, e.g., rigidity of the structure, can be determined. The base angle of the operating table is defined as an angle of the base with respect to a floor supporting the base.

In a further embodiment of the operating table, the operating table comprises, as being one of the at least one sensor, at least one of a second inclinometer and a second acceleration sensor joined to the tabletop.

The inclinometer or the acceleration sensor are cost-effective sensors which, except from determining the position of the tabletop, enable measuring of a plurality of kinetic and kinematic characteristics of the operating table.

In a further embodiment of the operating table, the at least one sensor is arranged in a head of the column.

Due to this arrangement of the at least one sensor, the sensor is assigned to the base in which usually a controller of the operating table is housed so that wiring of the at least one sensor is facilitated. In case of a wireless signal transmission, a distance for a signal transmission is defined so that tuning of the components is facilitated.

In a further embodiment of the operating table, the tabletop is supported by the column in a tiltable manner, wherein the tabletop has a longitudinal axis along a longitudinal direction of the tabletop and a transverse axis perpendicular to the longitudinal axis and parallel to a lying surface of the tabletop. The operating table further comprises a second driving mechanism configured to tilt the tabletop around the transverse axis as being an axis related to the second driving mechanism and a third driving mechanism configured to tilt the tabletop around the longitudinal axis as being an axis related to the third driving mechanism. The at least one of the second inclinometer and the second acceleration sensor is configured to detect an inclination of the tabletop around at least one of the longitudinal axis and the transverse axis, and the controller is configured to control the second driving mechanism and the third driving mechanism such that, when one of the second driving mechanism and the third driving mechanism is actuated to tilt the tabletop around the axis related to the one driving mechanism, the other one of the second driving mechanism and the third driving mechanism is actuated to perform a compensation of an angular deviation of the tabletop around the axis related to the other driving mechanisms, wherein the angular deviation is determined by the controller by processing the signals from the at least one of the second inclinometer and the second acceleration sensor.

Due to the determination of the angular deviation and the compensation of the determined angular deviation, an exact motion of the tabletop is possible even though mechanical constraints or an insufficient stiffness prevent the exact motion. Therefore, tracking of specific locations of the tabletop or of a patient lying on the tabletop which is for, e.g., an isocenter position for stabilizing a location of a port in case of robot assisted minimally invasive surgery, is possible. Moreover, collisions can be prevented in case of long tabletops. Except from that, a larger range of motion for the Trendelenburg motion in a nominal maximum tilted position of the tabletop is possible since, when exceeding the nominal maximum tilted position, an internal collision in a column head occurs.

In a further embodiment of the operating table, the controller is configured to determine the angular deviation additionally by means of the base angle of the operating table.

By considering the base angle, an angular position of the tabletop can be determined more precisely.

In a further embodiment of the operating table, the controller is configured to control a speed of the second driving mechanism and of the third driving mechanism for compensating the angular deviation depending on an amount of the angular deviation, wherein the controller is configured to control the second driving mechanism and third driving mechanism to perform the compensation at a maximum speed of the driving mechanisms upon an angular deviation larger than a first predefined amount, to control the driving mechanism to perform the compensation at a reduced speed of the driving mechanism upon an angular deviation equal or smaller than the first predefined amount, and to stop the compensation or to ignore the angular deviation when the angular deviation is less than a second predefined amount Since, depending on the amount of the angular deviation, different speeds are used for the compensation of the angular deviation of the tabletop, a quick and exact compensation is possible. Large angular deviations can initially be quickly compensated with a higher speed and, subsequently, upon little angular deviations, the reduced angular deviation can be compensated exactly at a low speed without creating an overshoot. When performing the compensation at the maximum speed of the drive when the angular deviation is larger than the predefined first amount which is the largest predefined amount of angular deviation, the quick compensation in a range of the angular deviation where the exact positioning is not yet necessary can be performed. By the compensation at the reduced speed, the compensation is possible while reducing the risk for the overshoot. By stopping the compensation or ignoring the angular deviation when the angular deviation is small, i.e., less than a second predefined amount which is smaller than the first predefined amount, a sufficiently exact position of the tabletop can be maintained.

In another embodiment of the operating table, the controller is configured to determine a position of the tabletop from the signals of the at least one of the second inclinometer and the second acceleration sensor and from the base angle.

Due to this configuration, any determination of the position of the tabletop or a more exact determination of the position of the tabletop, in particular considering different motor types for the driving mechanisms, is possible.

In another embodiment of the operating table, the controller is configured to determine a deformation of the operating table from the signals of the at least one of the second inclinometer and the second acceleration sensor, and to indicate an overload warning signal when the deformation exceeds a predetermined deformation threshold.

Because of the determination by means of the signals of the at least one of the second inclinometer and the second acceleration sensor, an excessive motion of the tabletop compared to an expected motion can be recognized. Therefore, the deformation of the structure of the operating table can be determined. In case of exceeding the predetermined deformation threshold, an overload situation with the risk of damaging the operating table and injuring a patient on the operating table or persons in the vicinity of the operating table can occur. Therefore, this overload situation is displayed to users of the operating table by a visible or audible signal.

In another embodiment of the operating table, the controller is configured to determine tipping of the operating table from the signals of the at least one sensor configured to detect a change of position of the tabletop and from the base angle, and to indicate a tipping warning signal if the signals of the at least one sensor configured to detect a change of position of the tabletop and of the at least one sensor attached to the base exceed predetermined tipping thresholds.

Due to the determination by means of the signals of the at least one sensor configured to detect a change of position of the tabletop and of the base angle, in particular by determining the base angle, tipping of the operating table can be determined. In case of exceeding the predetermined tipping thresholds, a risk of tipping of the operating table and injuring a patient on the operating table or persons in the vicinity of the operating table can occur. Therefore, this situation is displayed to users of the operating table by a visible or audible tipping warning signal.

According to a further aspect of the present disclosure, a method for operating the operating table includes the step: determining the position of the tabletop from the signals of the at least one sensor configured to detect a change of position of the tabletop.

By performing this method, a cost-effective determination of the position of the tabletop including options of determination of further characteristics is achievable.

In an embodiment of the method, the method includes the step: determining the base angle of the operating table by processing signals of the at least one sensor attached to the base.

By performing this method, a large number of determinations of positions of components of the operating table is possible. In particular, a more exact determination of the position of the tabletop which is for tracking of the specific locations of the tabletop or of the patient lying on the tabletop which is for, e.g., the isocenter position for stabilizing a location of a port in case of robot assisted minimally invasive surgery is possible. Furthermore, the base angle which is for determining a motion of the entire operating table can be detected.

In an embodiment of this method, it includes the further steps: determining deformation of the operating table from the base angle and the position of the tabletop, and displaying the overload warning signal when the deformation exceeds a predetermined deformation threshold.

By these further steps, in case of exceeding the predetermined deformation threshold, an excessive deformation of the structure of the operating table and, therefore, the overload situation with the risk of damaging the operating table and injuring a patient on the operating table or persons in the vicinity of the operating table can easily be determined and this overload situation is displayed to users of the operating table by a visible or audible signal.

In a further embodiment of this method, it includes the further steps: determining tipping of the operating table from the base angle and the position of the tabletop, and displaying a tipping warning signal when the signals of the at least one sensor configured to detect a change of position of the tabletop and of the at least one sensor attached to the base exceed predetermined tipping thresholds.

By these further steps, in case of exceeding a predetermined tipping base angle threshold and a predetermined threshold of the position of the table top, the tipping or a potential tipping of the operating table can be determined and, therefore, this situation with the risk of damaging the operating table and injuring a patient on the operating table or persons in the vicinity of the operating table can easily be determined and it is displayed to users of the operating table by a visible or audible signal.

According to another aspect of the present disclosure, a method for operating the operating table includes the steps: controlling the second or third driving mechanism to perform a first tilt of the tabletop around an axis related to the respective driving mechanism, determining the angular deviation of the tabletop around an axis perpendicular to the axis around which the first tilt has been performed, and compensating the angular deviation by controlling the one of the second driving mechanism and third driving mechanism performing a second tilt around the axis perpendicular to the axis around which the first tilt has been performed.

Due to the determination of the angular deviation and the compensation of the determined angular deviation, an exact motion of the tabletop is possible. In case of a motion around the longitudinal axis, the position with respect to the transversal axis can be adjusted and vice versa. Therefore, tracking of specific locations of the tabletop or of a patient lying on the tabletop which is for, e.g., an isocenter position for stabilizing a location of a port in case of robot assisted minimally invasive surgery is possible. Moreover, collisions can be prevented in case of long tabletops. Except from that, a larger range of motion for the Trendelenburg motion in a nominal maximum tilted position of the tabletop is possible since when exceeding the nominal maximum tilted position, an internal collision in a column head may occur.

Additional features, which alone or in combination with any other feature(s), such as those listed above and/or those listed in the claims, can comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which.

Generalized description of the drawings giving some flavor to what is shown and the perspective it is from.

DETAILED DESCRIPTION OF THE DRAWINGS

Figure 1:
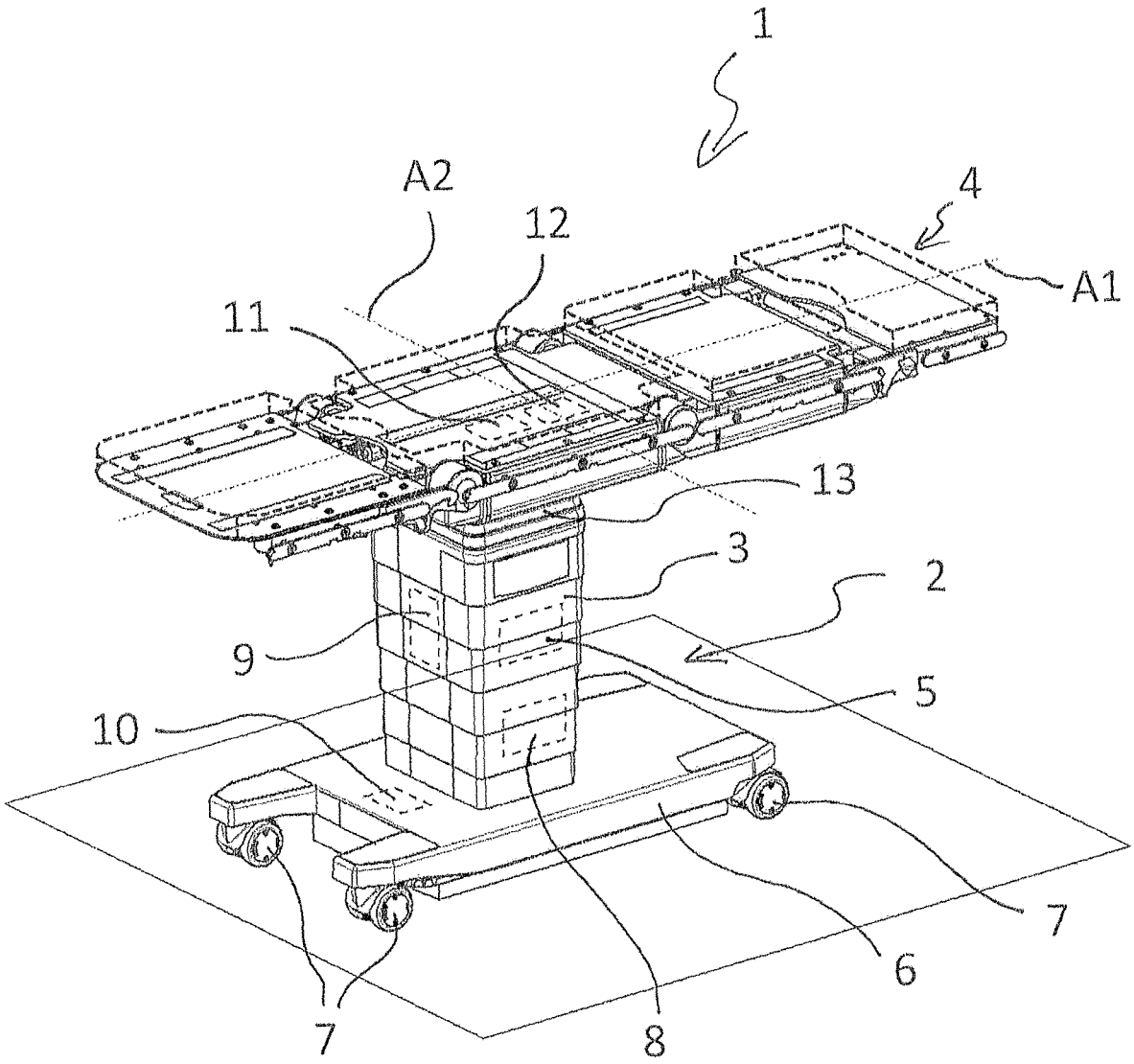
FIG. 1 shows an operating table according to an embodiment of the present disclosure.

FIG. 1 shows an operating table 1 according to an embodiment of the present disclosure.

The operating table 1 comprises a base 2 including a column 3. Furthermore, the operating table 1 comprises a tabletop 4 supported by the column 3 and a controller 5. At its upper end, the column 3 is provided with a head 13 joined to the tabletop 4. The controller 5 is configured to control actuators (not shown) of the operating table 1 based on commands of an operator.

The tabletop 4 has a longitudinal axis A1 along a longitudinal direction of the tabletop 4 and a transverse axis A2 perpendicular to the longitudinal axis A1 and parallel to a current lying surface of the tabletop 4.

The base 2 is further provided with a base plate 6 including casters 7 so that the operating table 1 is a movable operating table 1. In an alternative embodiment, the base 2 is not provided with the casters 7 but has a base plate 6 which is immovably placed on a floor, wherein the operating table 1 can be moved by an additional transport equipment. In a further alternative embodiment, the base 2 is not provided with a base plate but it is provided with the column 3 fixed to a socket in the floor.

The operating table 1 comprises a string potentiometer 8 configured to detect a change of the position of the tabletop 4 with respect to the base 2 in a vertical direction. The string potentiometer 8 is composed of a measuring cable, a spool for winding the measuring cable, a spring pre-stressing the spool for maintaining a cable tension and a rotational sensor having a shaft to which the spool is coupled. The measuring cable is joined to the tabletop 4 and the spool is joined to the base 2. When the tabletop 4 moves with respect to the base 2, the measuring cable causes the spool and the sensor shaft to rotate and the rotating shaft creates electrical signals proportional to a cable's linear extension.

Therefore, the string potentiometer 8 acts as a sensor directly detecting a change of position of the tabletop 4. This means that, contrary to sensors indirectly detecting a position of the tabletop 4, e.g., an angular encoder included in any driving mechanisms, a deformation of the driving mechanism or of mechanical parts transmitting a motion of the driving mechanism to the tabletop is not considered. Therefore, an actual motion of the tabletop 4 with respect to the base 2 is detected. Thus, the change of the position of the tabletop 4 of the operating table 1 can also be detected independently from the provision of a driving mechanism. In alternative embodiments, the spool is joined to the tabletop 4 and the measuring cable is joined to the base 2. In a further alternative embodiment, the string potentiometer 8 is omitted and, as the case may be, the height of the tabletop 4 is directly detected by another sensor.

The base 2 comprises a first driving mechanism 9 configured to perform a height adjustment of the tabletop 4 by changing a position of the tabletop 4 in the vertical direction, and the controller 5 is configured to process the signals of the string potentiometer 8 as at least one sensor to determine a position of the tabletop in the vertical direction, i.e., to determine an actual height or height change of the tabletop. In an alternative embodiment, the tabletop 4 is not height-adjustable in a driven manner and the first driving mechanism 9 is omitted.

The operating table 1 further comprises a first acceleration sensor 10 attached to the base 2 and the controller 5 processes signals of the first acceleration sensor 10 for determining a base angle of the operating table 1, i.e. an angle between the base 2 and a floor supporting the base 2. In alternative embodiments, for this purpose, the base 2 comprises a first inclinometer instead of the first acceleration sensor 10, or the base 2 comprises the first acceleration sensor 10 and the first inclinometer, or no first acceleration sensor 10 and no first inclinometer are provided.

Furthermore, the operating table 1 comprises a second inclinometer 11 and a second acceleration sensor 12 joined to the tabletop 4 as sensors configured to directly detect a change of position of the tabletop 4. In this embodiment, the second inclinometer 11 and the second acceleration sensor 12 are arranged in the head 13 of the column 3. By providing the second inclinometer 11 as well as the second acceleration sensor 12, the second acceleration sensor 12 can detect measurement errors of the first inclinometer 11. The controller 5 is configured to process signals of the second inclinometer 11, of the second acceleration sensor 12, and of the first acceleration sensor 10, i.e., the base angle, in order to determine the position of the tabletop 4. Alternatively, merely one of the second inclinometer 11 and the second acceleration sensor 12 is provided or the second inclinometer 11 and the second acceleration sensor 12 are omitted. In a further alternative embodiment, merely the second inclinometer 11 and/or the second acceleration sensor are used for determining the position of the table top 4. In yet another embodiment, the second inclinometer 11 and/or the second acceleration sensor 12 are provided directly at the tabletop 4.

The controller 5 is configured to determine a deformation of the operating table 1 from the signals of the second inclinometer 11 and of the second acceleration sensor 12 as at least one sensor configured to detect a change of position of the tabletop. The deformation can be determined as a difference between an actual position of the tabletop 4 and a position of the tabletop 4 due to, e.g., position commands to drives of the tabletop 4. In case of a drive including a motor without position detectors, the deformation can be determined when sliding the tabletop 4 without tilting the tabletop 4 in a driven manner by determining the deformation from the at least one sensor configured to detect a change of position of the tabletop. When the deformation exceeds a predetermined deformation threshold, the operating table 1 indicates an overload warning signal by a visible or an audible signal.

Furthermore, the controller 5 is configured to determine tipping of the operating table 1 from the signals of the second inclinometer 11 and of the second acceleration sensor 12 as the at least one sensor configured to detect a change of position of the tabletop and of the base angle. When the signals of the at least one sensor configured to detect a change of position of the tabletop and of the at least one sensor attached to the base exceed predetermined tipping thresholds, a tipping warning signal is displayed by a visible or indicated by an audible signal.

Figure 2:
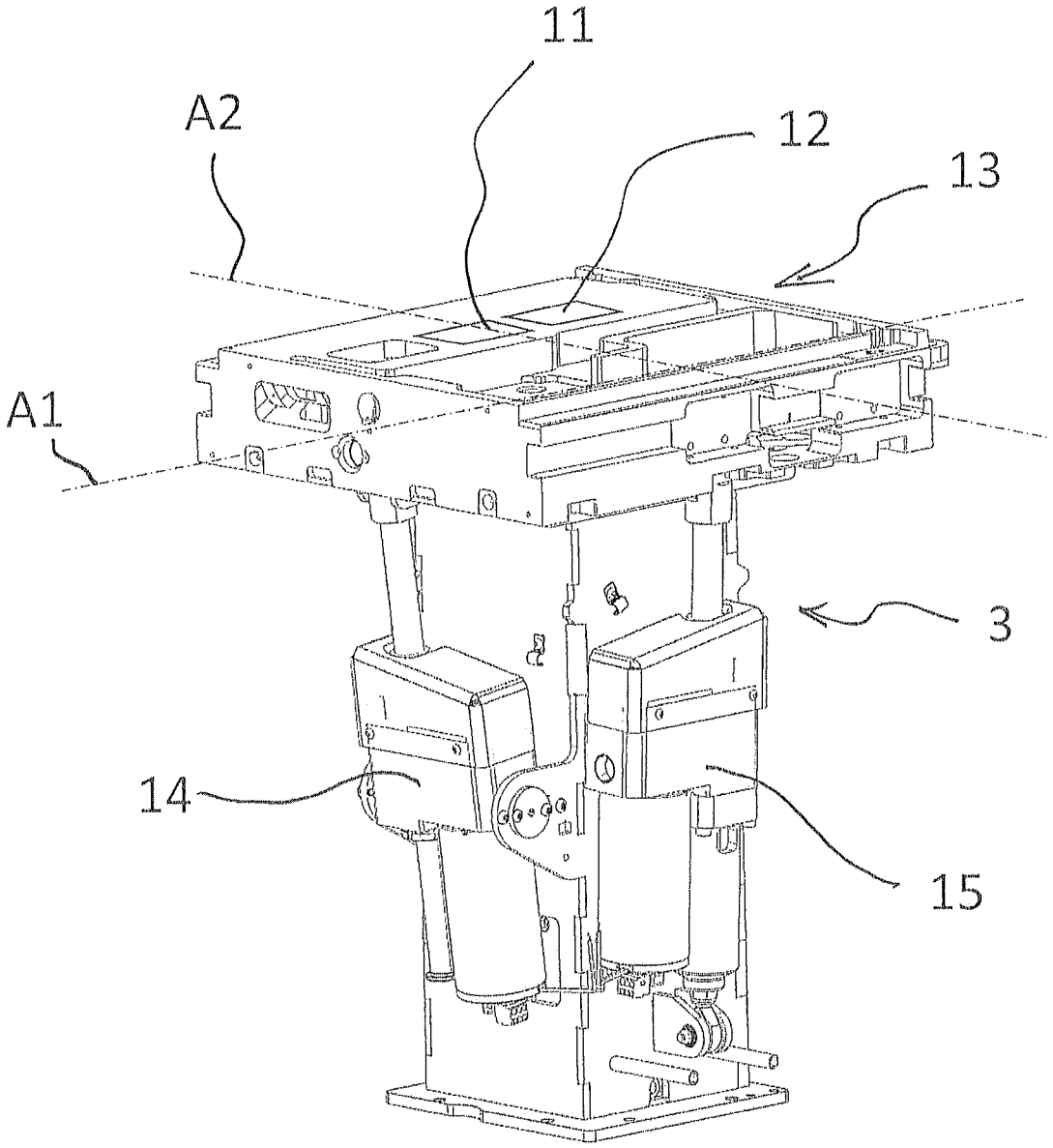
FIG. 2 shows a column of the operating table of FIG. 1 without a casing.

FIG. 2 shows the column 3 of the operating table 1 without a casing. As mentioned above, the head 13 of the column 3 is joined to the tabletop 4 (FIG. 1). By the head 13 of the column 3, the tabletop 4 is supported by the column 3 in a tiltable manner. The operating table 1 comprises a second driving mechanism 14 configured to tilt the tabletop 4 around the transverse axis A2 as being an axis related to the second driving mechanism 14, e.g. in a Trendelenburg position, and a third driving mechanism 15 configured to tilt the tabletop 4 around the longitudinal axis A1 as being an axis related to the third driving mechanism 15.

The second inclinometer 11 and the second acceleration sensor 12 are configured to detect an inclination of the tabletop 4 around the longitudinal axis A1 and the transverse axis A2.

The controller 5 is configured to control the second driving mechanism 14 and the third driving mechanism 15 such that, when one of the second driving mechanism 14 and third driving mechanism 15 is actuated to tilt the tabletop 4 around the axis A1, A2 related to the one driving mechanism, the other one of the second driving mechanism 14 and third driving mechanism 15 performs a compensation of an angular deviation of the tabletop around the axis A1, A2 related to the other driving mechanism, wherein the angular deviation is determined by the controller 5 by processing the signals from the second inclinometer 11 and from the second acceleration sensor 12. The controller 5 is further configured to determine the angular deviation additionally by means of the base angle of the operating table 1.

Moreover, the controller 5 is configured to control a speed of the second driving mechanism 14 and third driving mechanism 15 for compensating the angular deviation depending on an amount of the angular deviation. The controller 5 is configured to control the second driving mechanism 14 and third driving mechanism 15 to perform the compensation at a maximum speed of the driving mechanisms 14, 15 upon an angular deviation equal to or larger than a first predefined amount, to control the driving mechanisms 14, 15 to perform the compensation at a reduced speed, reduced with respect to the maximum speed, of the driving mechanisms 14, 15 upon an angular deviation smaller than the first predefined amount and larger than a second predefined amount, and to stop the compensation or to ignore the angular deviation when the angular deviation is less than the second predefined amount. In this embodiment, the first predetermined amount of the angular deviation is 1 degree, a further deviation amount of the angular deviation is 0.3 degrees, and the second predefined amount of the angular deviation is 0.1 degrees. The second or third driving mechanism is controlled to have the maximum speed of 100% when the amount of the angular deviation≥the first determined amount, a speed of 66.66% of the maximum speed when the first determined amount>the amount of the angular deviation≥the further deviation amount, a speed of 33.33% of the maximum speed when the further determined amount>the amount of the angular deviation≥the second deviation amount, and 0% of the maximum speed when the second deviation amount≥the amount of the angular deviation.

Figure 3:
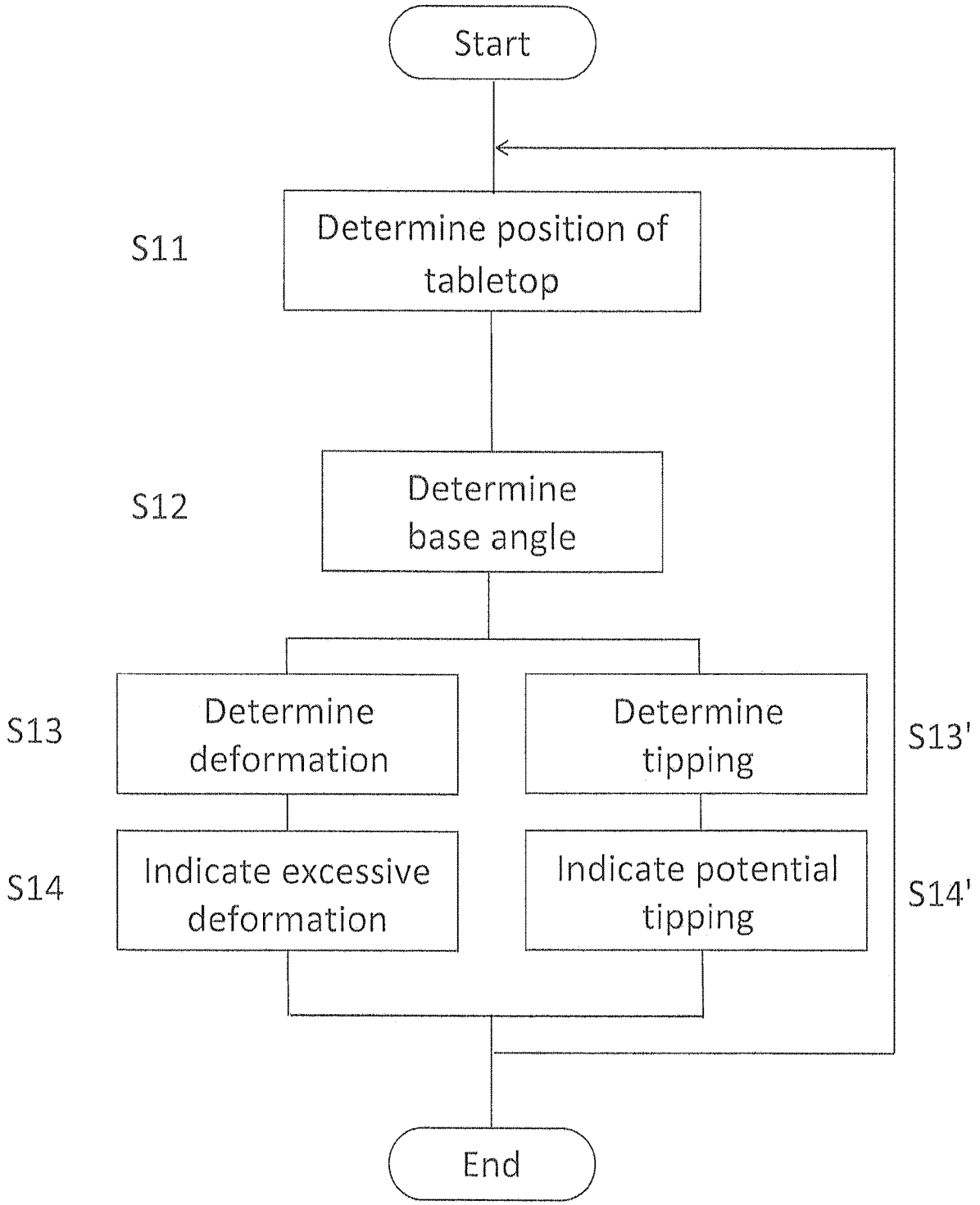
FIG. 3 shows a flowchart of a first method according to the present disclosure.

FIG. 3 shows a flowchart of a first method according to the present disclosure.

In use, the position of the tabletop 4 is determined in step S11. The position of the tabletop 4 is determined by the controller 5 by processing signals of the second inclinometer 11 and of the second acceleration sensor 12 as the at least one sensor configured to directly detect a change of position of the tabletop 4. In step S12, the position of the tabletop 4 is determined by processing additional signals of the first acceleration sensor 10 in the base 2 as the base angle. Alternatively, the signals of the first acceleration sensor 10 are not processed but merely the signals of the second inclinometer 11 and of the second acceleration sensor 12.

The controller 5 is calibrated in a neutral position of the tabletop 4, in particular when DC motors are used for operating the first, second, and third driving mechanism 8, 14, 15 but also when EC motors are used for operating the first, second, and third driving mechanism 8, 14, 15.

When shifting the tabletop 4 along the longitudinal axis A1, a structure of the operating table 1 is bent and an inclination around the transverse axis A2 changes due to a change of the center of gravity of a patient with respect to the column 3 supporting the tabletop 4. This change of inclination can be determined as the change of the position of the tabletop 4. When using EC motors, the determined position of the tabletop 4 is compared to a position of the tabletop 4 which is expected due to an instructed motion of the EC motor in order to determine bending of the structure of the operating table 1. When using DC motors, merely the determined position of the tabletop 4 is used for further considerations.

In step S13, the change of the position of the tabletop 4 is determined as the deformation of the operating table 1. In case of an excessive shift of the tabletop 4 along the longitudinal axis A1 and, as the case may be, along the transverse axis A2, and/or due to an excessive weight of the patient, the change of position of the tabletop 4, e.g., due to the deformation of the operating table 1, can exceed a deformation threshold predetermined in advance for each type of operating table 1. When the predetermined deformation threshold is exceeded, in step S14, the operating table 1 indicates an excessive deformation as the overload warning signal in a visible and/or audible manner.

In another case of the excessive shift of the tabletop 4 or of a center of gravity of the patient along the longitudinal axis A1 and, as the case may be along the transverse axis A2, and/or due to the excessive weight of the patient, the change of position of the tabletop 4 can exceed tipping thresholds predetermined in advance for each type of operating table 1. When a tipping is determined in step S13', i.e., when the predetermined tipping thresholds are exceeded and, in particular, when a motion of the base is determined by the signals of the first acceleration sensor 10, there is a risk of tipping of the operating table 1 upon a further shift in the same direction, and, in step S14', the operating table 1 indicates the tipping warning signal in a visible and/or audible manner.

Figure 4:
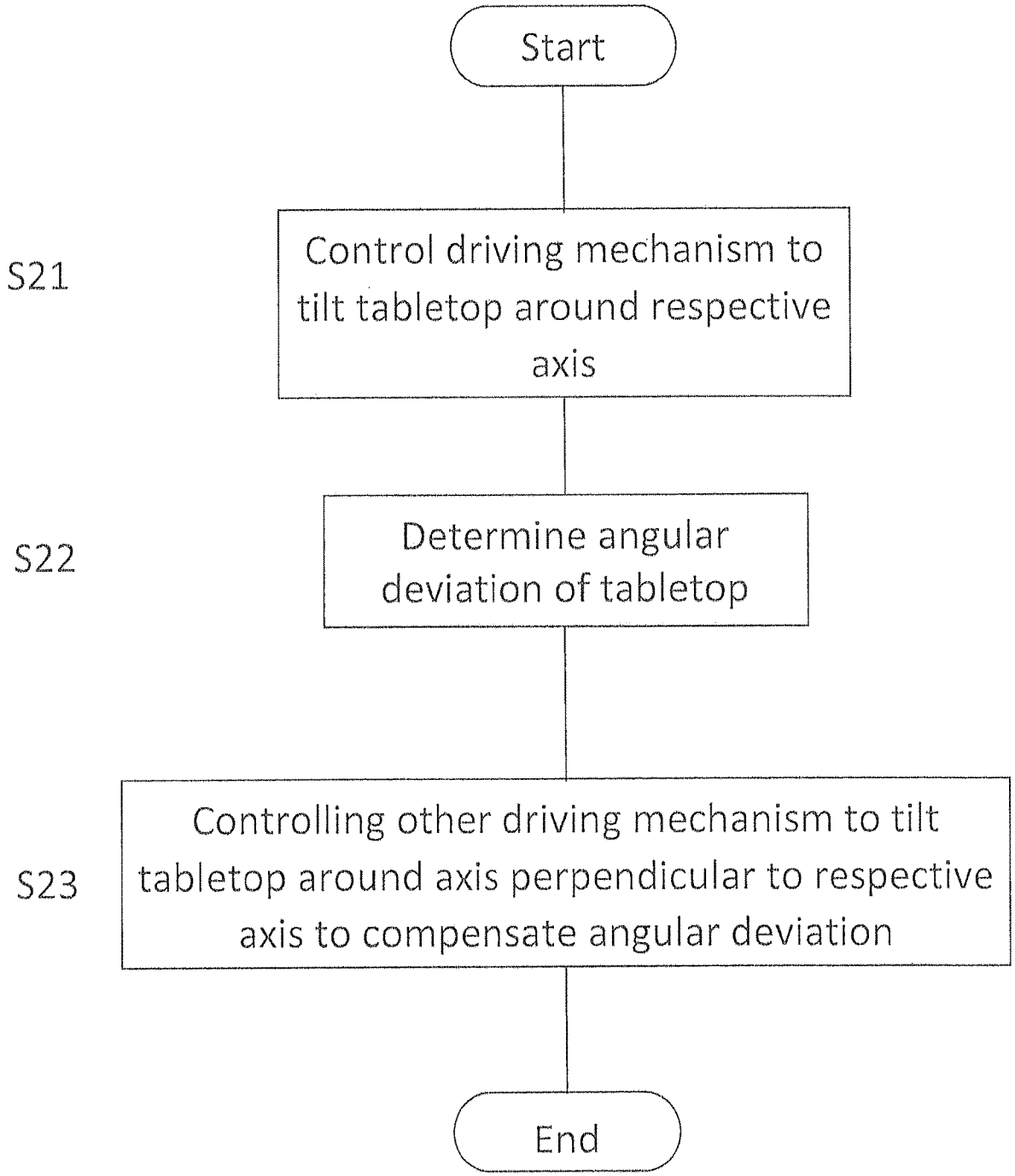
FIG. 4 shows a flowchart of a second method according to the present disclosure.

FIG. 4 shows a flowchart of a second method according to the present disclosure. In the case of the operating table 1 having mechanical constraints or an insufficient stiffness preventing an exact motion of the tabletop 4, deviations of a required position of the tabletop 4 can be compensated.

In step S21, the controller 5 controls the second driving mechanism 14 or third driving mechanism 15 to perform a first tilt of the tabletop around a respective axis A1, A2 related to the second driving mechanism 14 or to the third driving mechanism 15.

When reaching the controlled position of the tabletop 4, in step S22, by the second inclinometer 11 and the second acceleration sensor 12 and, as the case may be, by the first acceleration sensor 10, the angular deviation of the tabletop around an axis perpendicular to the axis around which the first tilt has been performed with respect to the controlled position can be determined.

In step S23, the angular deviation is compensated by controlling the one of the second driving mechanism 14 and third driving mechanism 15 performing a second tilt around the axis perpendicular to the axis around which the first tilt has been performed.

While the present disclosure has been illustrated and described in detail in the drawings and the foregoing description, such illustration and description are to be considered illustrative or exemplary and not restrictive. The invention is not limited to the disclosed embodiments. From reading the present disclosure, other modifications will be apparent to a person skilled in the art. Such modifications may involve other features, which are already known in the art and may be used instead of or in addition to features already described herein. In the claims, the word "comprising" does not exclude other elements or steps, and the indefinite article "a" or "an" does not exclude a plurality.

Although this disclosure refers to specific embodiments, it will be understood by those skilled in the art that various changes in form and detail may be made without departing from the subject matter set forth in the accompanying claims.

The invention claimed is:

1. An operating table comprising a base including a column, a tabletop supported by the column, at least one sensor configured to directly detect a change of position of the tabletop, and a controller configured to process signals of the at least one sensor in order to determine a position of the tabletop, wherein the operating table comprises at least one of a first inclinometer and a first acceleration sensor attached to the base, and wherein the controller processes signals of the at least one of the first inclinometer and the first acceleration sensor for determining a base angle of the operating table.

2. The operating table of claim 1, wherein the operating table comprises, as being one of the at least one sensor, a string potentiometer configured to detect a change of position of the tabletop with respect to the base in a vertical direction.

3. The operating table of claim 2, wherein the base comprises a first driving mechanism, the first driving mechanism being configured to perform a height adjustment of the tabletop by changing a position of the tabletop in the vertical direction, and the controller is configured to process the signals of the at least one sensor to determine a position of the tabletop in the vertical direction.

4. The operating table of claim 3, wherein the operating table comprises, as being one of the at least one sensor, at least one of a second inclinometer and a second acceleration sensor joined to the tabletop.

5. The operating table of claim 4, wherein the tabletop is supported by the column in a tiltable manner, the tabletop having a longitudinal axis along a longitudinal direction of the tabletop and a transverse axis perpendicular to the longitudinal axis and parallel to a lying surface of the tabletop, a second driving mechanism configured to tilt the tabletop around the transverse axis as being an axis related to the second driving mechanism, a third driving mechanism configured to tilt the tabletop around the longitudinal axis as being an axis related to the third driving mechanism, and wherein the at least one of the second inclinometer and the second acceleration sensor is configured to detect an inclination of the tabletop around at least one of the longitudinal axis and the transverse axis, and the controller is configured to control the second driving mechanism and the third driving mechanism such that, when one of the second driving mechanism and third driving mechanism is actuated to tilt the tabletop around the axis related to the one driving mechanism, the other one of the second driving mechanism and third driving mechanism is actuated to perform a compensation of an angular deviation of the tabletop around the axis related to the other driving mechanism, wherein the angular deviation is determined by the controller by processing the signals from the at least one of the second inclinometer and the second acceleration sensor.

6. The operating table of claim 5, wherein the controller is configured to determine the angular deviation additionally by means of the base angle of the operating table.

7. The operating table of claim 5, wherein the controller is configured to control a speed of the second driving mechanism and of the third driving mechanism for compensating the angular deviation depending on an amount of the angular deviation, wherein the controller is configured to control the second driving mechanism and third driving mechanism to perform the compensation at a maximum speed of the driving mechanisms upon an angular deviation larger than a first predefined amount, to control the second driving mechanism and third driving mechanism to perform the compensation at a reduced speed of the driving mechanisms upon an angular deviation equal or smaller than the first predefined amount, and to stop the compensation or to ignore the angular deviation when the angular deviation is less than a second predefined amount.

8. The operating table of claim 7, wherein the controller is configured to determine tipping of the operating table from the signals of the at least one sensor configured to detect a change of position of the tabletop and from the base angle, and to indicate a tipping warning signal if the signals of the at least one sensor configured to detect a change of position of the tabletop and of the at least one sensor attached to the base exceed predetermined thresholds.

9. A method for operating an operating table of claim 5 including the steps:

controlling the second driving mechanism or third driving mechanism to perform a first tilt of the tabletop around an axis related to the respective driving mechanism;

determining the angular deviation of the tabletop around an axis perpendicular to the axis around which the first tilt has been performed; and compensating the angular deviation by controlling the one of the second driving mechanism and third driving mechanism performing a second tilt around the axis perpendicular to the axis around which the first tilt has been performed.

10. The operating table of claim 4, wherein the controller is configured to determine a position of the tabletop from the signals of the at least one of the second inclinometer and the second acceleration sensor and from the base angle.

11. The operating table of claim 4, wherein the controller is configured to determine a deformation of the operating table from the signals of the at least one of the second inclinometer and the second acceleration sensor, and to indicate an overload warning signal when the deformation exceeds a predetermined deformation threshold.

12. The operating table of claim 4, wherein the at least one sensor is arranged in a head of the column.

13. The operating table of claim 12, wherein the tabletop is supported by the column in a tiltable manner, the tabletop having a longitudinal axis along a longitudinal direction of the tabletop and a transverse axis perpendicular to the longitudinal axis and parallel to a lying surface of the tabletop, a second driving mechanism configured to tilt the tabletop around the transverse axis as being an axis related to the second driving mechanism, a third driving mechanism configured to tilt the tabletop around the longitudinal axis as being an axis related to the third driving mechanism, and wherein the at least one of the second inclinometer and the second acceleration sensor is configured to detect an inclination of the tabletop around at least one of the longitudinal axis and the transverse axis, and the controller is configured to control the second driving mechanism and the third driving mechanism such that, when one of the second driving mechanism and third driving mechanism is actuated to tilt the tabletop around the axis related to the one driving mechanism, the other one of the second driving mechanism and third driving mechanism is actuated to perform a compensation of an angular deviation of the tabletop around the axis related to the other driving mechanism, wherein the angular deviation is determined by the controller by processing the signals from the at least one of the second inclinometer and the second acceleration sensor.

14. The operating table of claim 13, wherein the controller is configured to determine the angular deviation additionally by means of the base angle of the operating table.

15. The operating table of claim 1, wherein the operating table comprises, as being one of the at least one sensor, at least one of a second inclinometer and a second acceleration sensor joined to the tabletop.

16. The operating table of claim 15, wherein the at least one sensor is arranged in a head of the column.

17. The operating table of claim 1, wherein the at least one sensor is arranged in a head of the column.

18. A method for operating the operating table of claim 1, including the step:

determining a position of the tabletop from the signals of the at least one sensor configured to directly detect a change of position of the tabletop; and determining the base angle of the operating table by processing signals of the at least one sensor attached to the base.

19. The method of claim 18, including the further steps:

determining deformation of the operating table from the base angle and the position of the tabletop; and indicating an overload warning signal when the deformation exceeds a predetermined deformation threshold.

20. The method of claim 19, including the further steps:

determining tipping of the operating table from the base angle and the position of the tabletop; and indicating a tipping warning signal when the signals of the at least one sensor configured to detect a change of position of the tabletop and of the at least one sensor attached to the base exceed predetermined tipping thresholds.

* * * * *